United States Patent [19]

Castel

[11] Patent Number: 4,600,339

[45] Date of Patent: Jul. 15, 1986

[54] SHIELD FOR PROTECTING A WELL HEAD AND FUNCTIONAL MODULES OF AN UNDER SEA STATION

[75] Inventor: Yvon Castel, Pau, France

[73] Assignee: Societe Nationale Elf Aquitaine (Production), Courbevoie, France

[21] Appl. No.: 624,625

[22] Filed: Jun. 26, 1984

[30] Foreign Application Priority Data

Jun. 28, 1983 [FR] France ..... 83 10657

[51] Int. Cl.[4] ..... E02B 17/02; E02D 31/00

[52] U.S. Cl. ..... 405/211; 166/356; 405/168; 405/212; 405/195

[58] Field of Search ..... 405/211, 212, 168, 169, 405/170, 195; 166/356, 357, 368, 335

[56] References Cited

U.S. PATENT DOCUMENTS

| | | | |
|---|---|---|---|
| 1,547,511 | 7/1925 | Maciejczyk et al. | 405/212 X |
| 3,063,500 | 11/1962 | Logan . | |
| 3,247,672 | 4/1966 | Johnson | 166/356 X |
| 3,421,579 | 1/1969 | Manning | 166/356 |
| 3,601,189 | 8/1971 | Weiss | 166/356 |
| 3,683,631 | 8/1972 | McCabe | 405/212 |
| 3,744,561 | 7/1973 | Shatto . | |
| 4,273,472 | 6/1981 | Piazza et al. | 166/356 X |

FOREIGN PATENT DOCUMENTS

| | | | |
|---|---|---|---|
| 2557964 | 12/1976 | Fed. Rep. of Germany | 405/212 |
| 2119761 | 8/1972 | France . | |
| 2143533 | 2/1973 | France | 166/356 |
| 2270436 | 5/1974 | France . | |
| 1523034 | 8/1978 | United Kingdom | 405/212 |
| 2015062 | 9/1979 | United Kingdom | 405/211 |

*Primary Examiner*—Dennis L. Taylor

*Attorney, Agent, or Firm*—Poms, Smith, Lande & Rose

[57] ABSTRACT

A shield for protecting a well head and functional modules in an under sea station comprising a composite cushion formed from a floor 6 made from a material less dense than water, such as a plastic material or treated wood, and resting on a perforated metal sheet or grid 7, removably fixed by means of deformable feet 4 to a horizontal plate 1 mounted at the top of the module to be protected and having at the position where the guide column 2 passes an opening in which is welded a sleeve 14 capable of sliding along said guide columns 2.

In a shield for protecting a module provided with a central connector, said plate has a central cage with vertical lateral wall for housing said connector, radial arms being fixed to the bodies of several shock absorbers spaced apart on said plate and to said wall of the cage for transmitting shock absorbing forces.

11 Claims, 2 Drawing Figures

SHIELD FOR PROTECTING A WELL HEAD AND FUNCTIONAL MODULES OF AN UNDER SEA STATION

BACKGROUND OF THE INVENTION

1. Field of the Invention

The present invention relates to a shield for protecting a well head and functional modules of an under sea station from falling objects coming from the surface or during handling from the sea bed or from the surface.

2. Description of the Prior Art

An under sea station for oil working is usually formed from an assembly comprising well heads and modules, such as the connection module (PJU) each ensuring the connection of oil circuits between a well head and a collecting arbor, the peripheral control and checking modules (CJU) and, possibly, the main control module (CSC).

A well head is always provided with a bearing shaft, whereas the modules may comprise, in addition to the central shaft required for handling thereof, two guide columns which serve for pre guiding either the module required for lowering or raising them by means of a string of rods, or the upper module, when two modules are stacked one on the other.

Furthermore, known devices for protecting the under sea installation assembly lack flexibility and are not satisfactory, particularly because they are interlocked with the installation to be protected.

Any object falling towards the shield has a kinetic energy $$E=\frac{1}{2}mv^2$$

m being its mass and v its speed.

At the time of the impact, this energy must be absorbed by the shield, without unconsidered stresses F being induced in the structure to be protected. The energy to be absorbed may be considered as the product of a force (less than F,) multiplied by a displacement. Any rapid displacement in the water is hindered by hydrodynamic forces which increase with the square of the speed. It is then difficult, if not impossible, to limit the stresses in the structure to be protected by means of a shield formed from a solid plate. The idea on which the invention is based consists in allowing the displacement, without the formation of high reactive hydro dynamic forces.

SUMMARY OF THE INVENTION

The shield of the invention is characterized in that it comprises a composite material formed from a floor made from a material less dense than water and resting on a perforated metal sheet or grid, removably fixed by means of deformable feet to a horizontal plate mounted at the top of the module to be protected and having at the position where the shaft or guide column passes an opening in which a sleeve is welded capable of sliding along said shafts or said guide columns.

The energy is first of all absorbed by deformation of the upper part of the cushion, made for example from a plastic material such as polypropylene, or from wood, formed for example by pieces of timber or an open work floor, then by local deformation of the perforated impact plate, then by displacement of the perforated plate against the reactive forces of the shock absorbers and reduced hydrodynamic forces. These latter may be negligible, for example less than 10% of the maximum admissible stress.

Thus, protection is provided by the dynamic absorption of the impact by means of the cushion which receives the impact and ensures controlled braking, guiding of the cushion under the effect of the impact being ensured by the sliding shafts which form said central shafts and said guide columns.

The deformable foot is preferably bent so as to have a concavity turned towards the center of the module and the arm of the angle resting on the module is provided with a stiffening arm serving as support which is not integral.

In an advantageous embodiment, the sleeve has sliding shoes at both its ends.

The top of the central shaft or guide column may have a conical cap serving as deflector.

Shock absorbers, preferably hydraulic, may further be placed on the horizontal plate for participating in the final result. When it is a question of a module such as a connnection module, the plate at the top of the module has a central cage with a vertical lateral wall integral with said plate, serving as housing for a connector and radial arms fixed on the one hand to the body of each shock absorber and on the other to said wall of the cage serve for transmitting the shock absorbing effects.

BRIEF DESCRIPTION OF THE DRAWINGS

Other features of the invention will be clear from the following description of one embodiment of a protection shield for a connection module with reference to the drawings, in which.

DESCRIPTION OF THE PREFERRED EMBODIMENT

Figure 1:
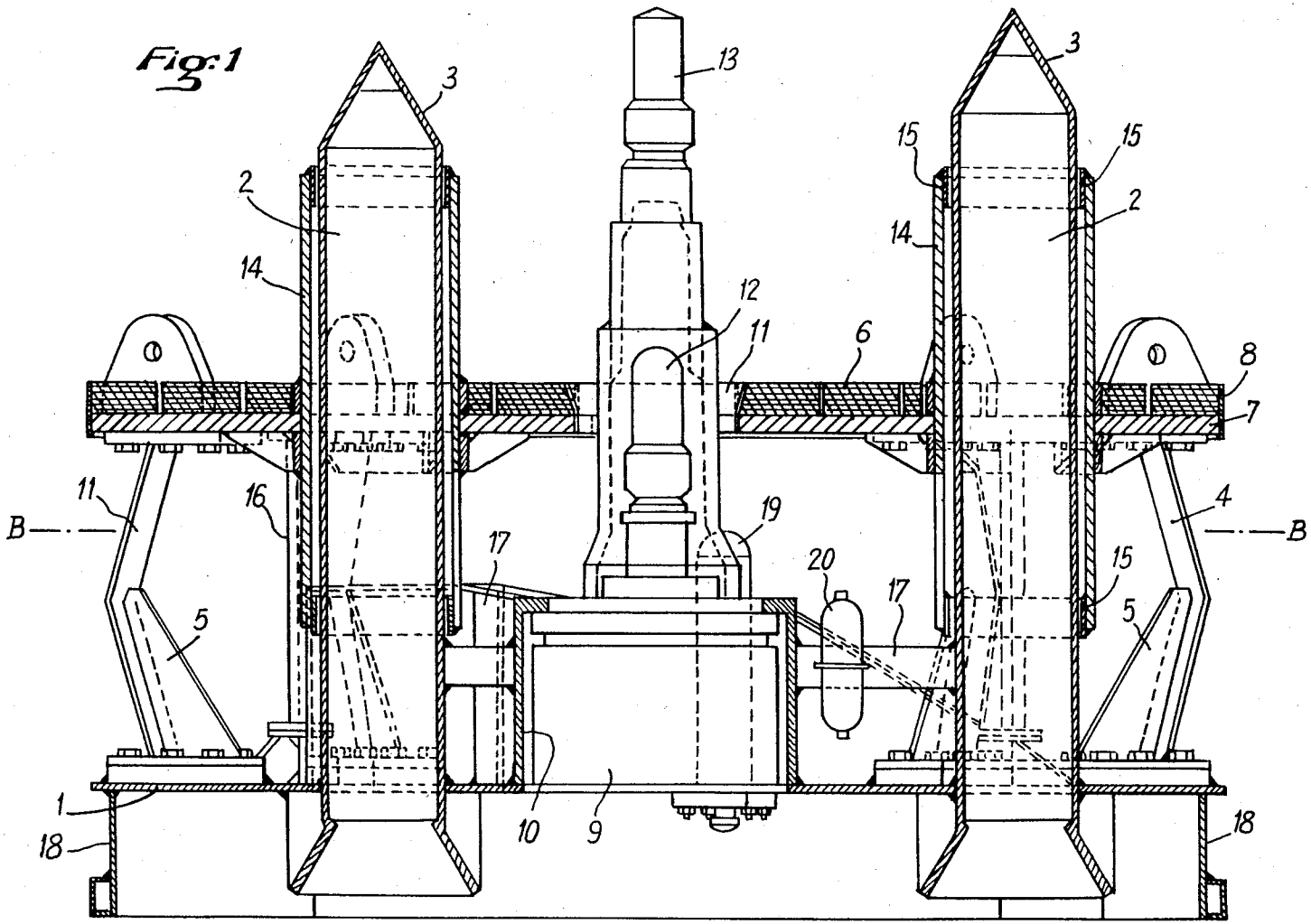
FIG. 1 shows a vertical sectional view through A—A of FIG. 2.
Figure 2:
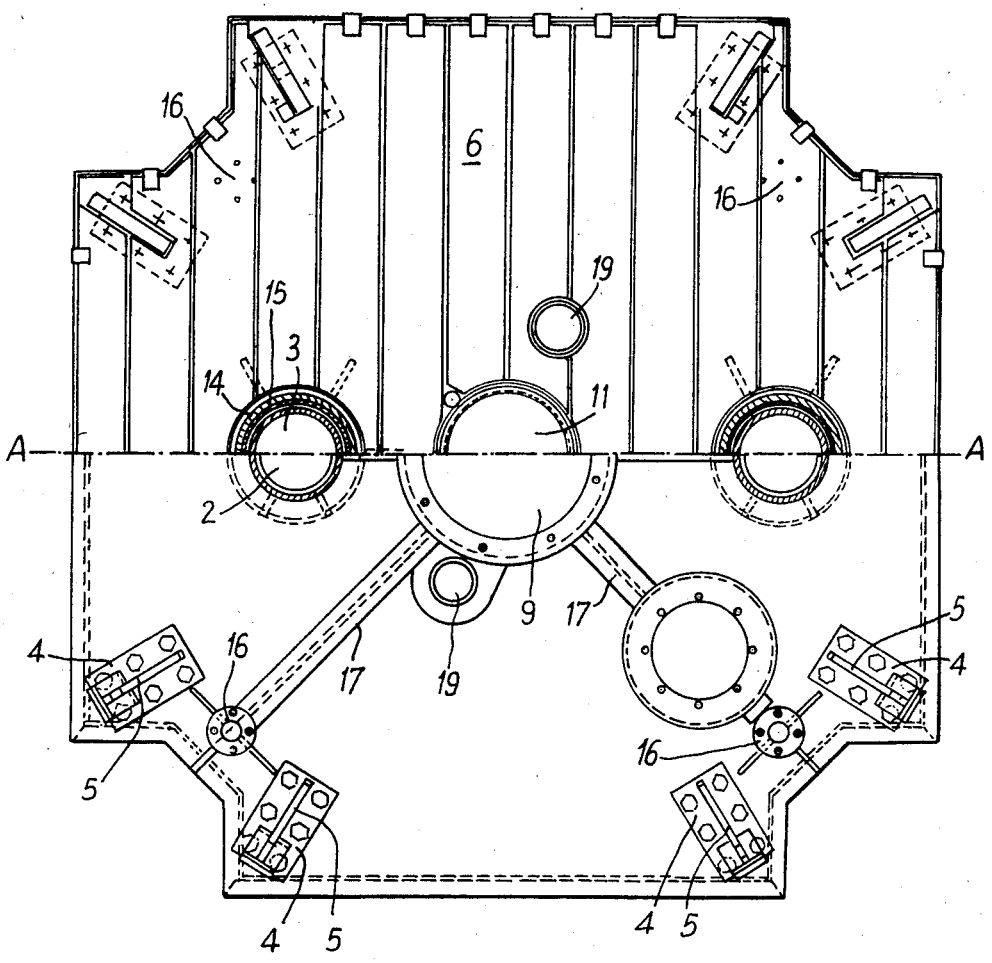
FIG. 2 shows in its upper half a top view and in its lower half a top view in section through B—B of FIG. 1.

A Horizontal plate 1 substantially rectangular in shape covering the whole surface of the module is fixed to the top of the connection module, not shown, which comprises two guide columns having conical caps 3 serving as deflectors. On the periphery of plate 1 are fixed eight bent deformable feet 4 having a concavity turned towards the inside of the module, the arms of the angle resting on the plate being provided with a stiffening element 5 which is not integral with the foot which it supports.

Feet 4 comprise a composite cushion formed from a polypropylene floor 6 resting on a perforated metal sheet or steel grid 7, a flange 8 ensuring positioning of floor 6 on metal sheet 7.

Plate 1 has a central cage 9 with vertical lateral wall 10 for housing a connector locked to a collecting or handling arbor. The cushion also has a corresponding opening 11 for passing therethrough the axial handling arbor 12 integral with the connector. The arbor, which allows the hydraulic ducts required for locking and unlocking the connector to pass therethrough, is itself protected by a deformable deflector cap 13.

At the position of the passage for the two guide columns 2, the cushion has two openings in which are welded sleeves 14 integral with a metal sheet 7 and having at their ends sliding shoes 15. At the corners of the shield are placed four shock absorbers 16 of the hydraulic type whose cylinder bodies are fixed to the plate and whose upper ends extend to the vicinity of the metal sheet 7. Four radial stiffening arms 17 connect the bodies of the shock absorbers 16 to the wall 10 of cage 9.

Two positioning shock absorbers 19 supplied with compressed fluid from a cylinder 20 are fixed to plate 1 and are functional for damping the possible shocks at the time of positioning the handling arbor 12. Plate 1 is provided at its lower part with a skirt 18 which provides a sealed volume serving as gas trap which, should a leak occur, causes it to be signaled by means of appropriate detection apparatus. The initial blow-off of the trapped air is provided from the handling arbor 12. When a heavy object falls, such for example as a rod weighing a ton, deflector 3 orientates as required the path of the object towards the cushion, which under the effect of the impact is driven in despite the braking due to the action of shock absorbers 16 by causing feet 4 to bend. The cushion is guided in its travel by the guide columns 2, sleeves 14 sliding there along and maintaining a certain parallelism in the positioning of the cushion with respect to plate 1, so that the load is suitably distributed. Hydro dynamic braking occurs because of the water pressure which is exerted through the perforations in the perforated metal sheet 7 and causes the ejection of floor 8 made from a material less dense than water.

The shields for protecting connection modules (PJU) peripheral control and checking modules (CJU) and main control modules (CSC) are interchangeable for they both comprise similar guide columns.

In so far as the shield is concerned for protecting the well head, it only has a central opening for passing a central bearing shaft therethrough, by means of which the equipment of a well head is immersed by means of the string of rods. Its structure is moreover similar to that of the shield described applying to functional modules.

What is claimed is:

1. In combination with a subsea installation having a well head and functional modules such as connection modules (PJU), a peripheral control and checking module (CJU) and a main control module (CSC), the installation including at least one central bearing shaft and guide columns:

a protective shield comprising a composite cushion providing a floor, said cushion including a material less dense than water and resting on a perforated metal sheet removably fixed by means of deformable feet to a horizontal plate mounted at the top of a module to be protected;

said plate having an opening at the position where the shaft of the guide column passes, and a sleeve in said opening fixed to said plate and capable of sliding along said guide columns.

2. The combination as claimed in claim 1, wherein the floor is made from a plastic material or treated wood.

3. The combination as claimed in claim 1, wherein said deformable foot is a bent foot having a concavity turned towards the center, the arm of the angle resting on the plate being provided with a stiffening element bearing on the arm.

4. The combination as claimed in claim 1, wherein said sleeve has sliding shoes at both its ends.

5. The combination as claimed in claim 1, wherein the top of the bearing shaft or guide column has a conical cap serving as deflector.

6. The combination as claimed in claim 1, wherein one or more shock abosrbers are fixed to the plate at the top of the module.

7. The combination as claimed in claim 6 wherein said composite cushion has a central opening adapted for passing therethrough a handling arbor connected to a connector, said plate has a central cage with vertical lateral wall for housing said connector, radial arms fixed to the body of each shock absorber and to said wall of the cage for transmitting the forces of the shock absorber.

8. The combination as claimed in claim 7, wherein the cushion is supported by eight deformable feet placed at its periphery and has two openings disposed on each side of its center for passing two guide columns therethrough and said shock absorbers are disposed symmetrically on the plate.

9. The combination as claimed in claim 8; wherein the plate at the top of the module to be protected is provided with a peripheral skirt, by means of which the plate is fixed to the module, so as to form a sealed volume serving as a gas trap;

and means for detecting and signalling leaks in said gas trap.

10. A protective shield for a subsea installation including at least upstanding guide columns comprising in combination:

a horizontal plate means adapted to be mounted at the top of the subsea installation to be protected and having openings through which said columns pass;

a composite cushion floor means including a perforated metal sheet means and a material less dense than water resting on sheet means;

and a deformable means supporting said composite cushion floor means above said horizontal plate means;

said composite cushion floor means having openings for passage therethrough of said guide columns.

11. A protective shield as claimed in claim 10 including:

sleeve means carried by said composite cushion floor means at said floor means openings for sliding along said guide columns.

* * * * *